US006612915B1

(12) United States Patent
Uzoh et al.

(10) Patent No.: US 6,612,915 B1
(45) Date of Patent: Sep. 2, 2003

(54) WORK PIECE CARRIER HEAD FOR PLATING AND POLISHING

(75) Inventors: Cyprian Uzoh, Milpitas, CA (US); Boguslaw Andrzej Nagorski, San Jose, CA (US); Konstantin Volodarsky, San Francisco, CA (US); Douglas W. Young, Sunnyvale, CA (US)

(73) Assignee: NuTool Inc., Milpitas, CA (US)

( * ) Notice: Subject to any disclaimer, the term of this patent is extended or adjusted under 35 U.S.C. 154(b) by 0 days.

(21) Appl. No.: 09/472,523

(22) Filed: Dec. 27, 1999

(51) Int. Cl.[7] ..... B24B 7/00; B24B 29/00

(52) U.S. Cl. ..... 451/285; 451/286; 451/287; 451/67; 451/390; 205/206

(58) Field of Search ..... 451/65, 285, 286, 451/287, 288, 289, 390; 205/206, 219, 224; 204/224 M

(56) References Cited

U.S. PATENT DOCUMENTS

| | | | | |
|---|---|---|---|---|
| 3,328,273 A | | 6/1967 | Creutz et al. | |
| 4,430,173 A | | 2/1984 | Boudot et al. | |
| 4,948,474 A | | 8/1990 | Miljkovic | |
| 4,954,142 A | | 9/1990 | Carr et al. | |
| 4,975,159 A | | 12/1990 | Dahms | |
| 5,084,071 A | | 1/1992 | Nenadic et al. | |
| 5,256,565 A | | 10/1993 | Bernhardt et al. | |
| 5,354,490 A | | 10/1994 | Yu et al. | |
| 5,516,412 A | | 5/1996 | Andricacos et al. | |
| 5,681,215 A | | 10/1997 | Sherwood et al. | |
| 5,755,859 A | | 5/1998 | Brusic et al. | |
| 5,762,544 A | | 6/1998 | Zuniga et al. | |
| 5,770,095 A | | 6/1998 | Sasaki et al. | |
| 5,773,364 A | | 6/1998 | Farkas et al. | |
| 5,791,975 A | * | 8/1998 | Cesna et al. | 451/63 |
| 5,793,272 A | | 8/1998 | Burghartz et al. | |
| 5,795,215 A | | 8/1998 | Guthrie et al. | |
| 5,807,165 A | * | 9/1998 | Uzoh et al. | 451/286 |
| 5,840,629 A | | 11/1998 | Carpio | |

(List continued on next page.)

FOREIGN PATENT DOCUMENTS

| | | |
|---|---|---|
| WO | 98/27585 | 6/1998 |
| WO | WO 00/26443 | 5/2000 |

OTHER PUBLICATIONS

James J. Kelly et al., "Leveling and Microstructural Effects of Additives for Copper Electrodeposition", Journal of the Electrochemical Society, 146, 1999, pp. 2540–2545.

Joseph M. Steigerwald et al., "Chemical Mechanical Planarization of Microelectronic Materials", A Wiley–Interscience Publication, 1997, by John Wiley & Sons, Inc. pp. 212–222.

Robert D. Mikkola et al., "Investigation of the Roles of the Additive Components for Second Generation Copper Electroplating Chemistries Used for Advanced Interconnect Metalization", 2000 IEEE, IEEE Electron Devices Society, pp. 117–119.

*Primary Examiner*—M. Rachuba
(74) *Attorney, Agent, or Firm*—Crowell & Moring LLP

(57) ABSTRACT

A work piece carrier head can carry a semiconductor wafer during both plating and polishing operations. The carrier head includes a first component secured to a shaft by which the carrier head can be rotated, translated, and moved up and down, a second component connected to the first component and movable by fluid pressure relative to the first component between retracted and extended positions, and a third component connected to the first and second components for up and down movement between wafer loading or unloading and wafer plating or polishing positions. The third carrier head component includes a contact element by which electrical contact with the wafer is provided to permit wafer plating.

20 Claims, 9 Drawing Sheets

U.S. PATENT DOCUMENTS

| | | | | |
|---|---|---|---|---|
| 5,858,813 | A | | 1/1999 | Scherber et al. |
| 5,884,990 | A | | 3/1999 | Burghartz et al. |
| 5,897,375 | A | | 4/1999 | Watts et al. |
| 5,911,619 | A | | 6/1999 | Uzoh et al. |
| 5,922,091 | A | | 7/1999 | Tsai et al. |
| 5,930,669 | A | | 7/1999 | Uzoh |
| 5,933,753 | A | | 8/1999 | Simon et al. |
| 5,954,997 | A | | 9/1999 | Kaufman et al. |
| 5,985,123 | A | | 11/1999 | Koon |
| 6,004,880 | A | | 12/1999 | Liu et al. |
| 6,027,631 | A | | 2/2000 | Broadbent |
| 6,063,506 | A | | 5/2000 | Andricacos et al. |
| 6,066,030 | A | | 5/2000 | Uzoh ..... 451/41 |
| 6,071,388 | A | | 6/2000 | Uzoh |
| 6,074,544 | A | | 6/2000 | Reid et al. |
| 6,103,085 | A | | 8/2000 | Woo et al. |
| 6,132,587 | A | | 10/2000 | Jorne et al. |
| 6,136,163 | A | | 10/2000 | Cheung et al. |
| 6,176,992 | B1 | | 1/2001 | Talieh |
| 6,251,236 | B1 | * | 6/2001 | Stevens ..... 204/224 R |
| 6,328,872 | B1 | * | 12/2001 | Talieh et al. ..... 204/212 |
| 6,402,925 | B2 | * | 6/2002 | Talieh ..... 204/224 M |
| 2001/0000396 | A1 | * | 4/2001 | Dordi et al. ..... 204/212 |

* cited by examiner

WORK PIECE CARRIER HEAD FOR PLATING AND POLISHING

BACKGROUND OF THE INVENTION

Multi-level integrated circuit (IC) manufacturing requires many steps of metal and insulator film depositions followed by photoresist patterning and etching or other means of material removal. After photolithography and etching, the resulting wafer or substrate surface is non-planar and contains many features such as vias, lines, or channels. Often, these features need to be filled with a specific material such as a metal, a dielectric, or both. For high performance applications, the wafer topographic surface needs to be planarized, making it ready again for the next level of processing, which commonly involves deposition of a material and a photolithographic step. It is most preferred that the substrate surface be flat for proper focusing and level for level registration or alignment. Therefore, after each deposition step that yields a non-planar surface on the wafer, there is often a step of surface planarization or polishing.

Electrodeposition is a widely accepted technique used in IC manufacturing for the deposition of a highly conductive material such as copper into features such as vias and channels in an insulating layer on the semiconductor wafer surface. FIGS. 1*a* through 1*c* show an example of the procedure for filling surface features with electrodeposited copper and then polishing the wafer to obtain a structure with a planar surface and electrically isolated Cu plugs or wires.

Features in FIG. 1*a* are opened in the insulator layer 2 and are to be filled with Cu. To achieve this, a barrier layer 3 is first deposited over the whole wafer surface. Then, a conductive Cu seed layer 4 is deposited over the barrier layer 3. Upon making electrical contact with the Cu seed layer 4, and applying electrical power, Cu is electrodeposited over the wafer surface to obtain the structure depicted in FIG. 1*b*. As can be seen in FIG. 1*b*, in this conventional approach, the electrodeposited Cu layer 5 forms a metal overburden 6 on the barrier layer disposed on the top surface of the insulator layer 2. This overburden and portions of the barrier layer 3 are then removed by polishing, yielding the structure shown in FIG. 1*c* which has a planar surface and electrically isolated Cu-filled features.

Electrodeposition is commonly carried out cathodically in a specially formulated electrolyte containing copper ions as well as additives that control the texture, morphology, and plating behavior of the copper layer. A proper electrical contact is made to the seed layer on the wafer surface, typically along the circumference of the round wafer. A consumable Cu or inert anode plate is placed in the electrolyte. Deposition of Cu on the wafer surface can then be initiated when a cathodic potential is applied to the wafer surface with respect to the anode, i.e., when a negative voltage is applied to the wafer surface with respect to the anode plate.

For a wafer holder that is used to electrodeposit a conductive material such as copper onto the surface of a wafer, it is important that the electrical contact be made properly with the conductive seed layer. This contact should be protected from the electroplating solution to avoid deposition of material onto the contact itself and to avoid corrosion of the contact by the electrolyte chemicals. The backside of the wafer should also be protected against the electrolyte.

Chemical Mechanical Polishing (CMP) is a widely used method of surface planarization. In CMP, the wafer is loaded on a carrier head, and a wafer surface with non-planar features is brought into contact with a polishing pad and an appropriately selected polishing slurry. Abrasive particles that may range from 100 microns to submicronic in size are contained in the pad, the polishing slurry, or both the pad and the polishing slurry. The pad and the wafer are then pressed together and moved with respect to each other to initiate polishing and eventually yield the desired planar surface. The chemistry of the polishing slurry and the type of the abrasive particles used are selected according to the chemical nature of the material to be polished. Therefore, the chemical compositions of polishing slurries for copper, tungsten, tantalum, tantalum nitride, silicon dioxide, and like materials used in IC manufacturing may all be different.

The part of a typical CMP machine that holds the workpiece, the substrate, or the wafer in place during the polishing operation is called the carrier head. Various designs for CMP carrier heads have been described in various patents. Each of these designs addresses a specific issue that is important in CMP. For example, U.S. Pat. No. 5,795,215 discloses a retaining ring design to pre-compress a polishing pad to reduce an edge effect during polishing. U.S. Pat. No. 5,681,215 describes the use of multiple bellows to properly transfer torque to a carrier base while allowing the carrier base to pivot. U.S. Pat. No. 5,762,544 relates to a specific gimbal mechanism that allows a carrier base, and thus the wafer surface, to pivot about a point at the interface between the wafer and a polishing pad. Without going into specific pecularities of various designs, it can generally be stated that a typical carrier head used in a CMP operation needs to:

a) restrain the wafer in place under the head during the polishing process;

b) provide mechanical strength and stability as well as a uniform pressure across the wafer when the wafer is pushed against the polishing pad; and c) keep all portions of the wafer surface substantially parallel to the pad surface to achieve local as well as global planarity.

SUMMARY OF THE INVENTION

The customary approach to achieve the metal deposition and polishing steps depicted in FIGS. 1*b* and 1*c* is to use two different processes in two different machines; one process in a first machine is used for deposition of a conductor such as copper, and a second process in a second machine is used for chemical mechanical polishing to obtain planarization. Copending U.S. patent application Ser. No. 09/201,929, filed on Dec. 1, 1998 and titled "Method and Apparatus for Electrochemical Mechanical Deposition", relates to a method and apparatus to achieve both deposition and polishing steps in the same apparatus at the same time or in a sequential manner. This application describes a carrier head design that can be used in a CMP machine as well as in an electroplating machine. Our preferred use of this design, however, is in a machine that does both plating and polishing.

It is a primary object of the present invention to provide an improved carrier head configuration which can be used in both plating and polishing operations. According to the present invention, the carrier head is self loading. An operator or a robot feeds a wafer onto an open clamp ring. The clamp ring then closes, placing the wafer onto a chuck face and securing it in place so that the wafer is ready for the plating and polishing procedures. Unloading is similarly easy. Loading and unloading can be done from both sides of the head.

Capabilities have been built into the head design to permit i) rotation of the substrate at controlled speeds in both clockwise and counter-clockwise directions, ii) pushing of the wafer surface against the pad surface at controlled pressures during rotation, iii) provision of gimble action to the wafer so as to ensure uniform pressure distribution across the wafer surface, iv) electrical contact with the wafer surface all around its perimeter, v) protection of the electrical contact from the corrosive electrolyte through a novel seal design, vi) protection of the back side of the wafer from contacting the electrolyte, and vii) provision of a backing pad, on which the wafer rests, which has unique surface features to increase friction with the back side of the wafer and to aid in wafer loading and unloading procedures.

According to the invention, a work piece carrier head can carry a semiconductor wafer during both plating and polishing operations. The carrier head includes a first component secured to a shaft by which the carrier head can be rotated, translated, and moved up and down, a second component connected to the first component and movable relative to the first component between retracted and extended positions, and a third component connected to the first and second components for up and down movement between wafer loading or unloading and wafer plating or polishing positions.

The third component is biased away from the wafer loading or unloading position and towards the wafer plating or polishing position to self-load the wafer to the carrier head. The first and second components define an expandable volume therebetween. Fluid can be supplied to or discharged from the expandable volume to produce relative movement of the first and second components. This relative movement is used to control a distance between a surface of the wafer and a source of plating material during the plating operation, and to control pressure at an interface between the surface of the wafer and a polishing pad surface during the polishing operation.

Stops are defined on the first component which limit movement of the second component and define respective fully retracted and fully extended positions of the second component. A gimbal mechanism is rendered effective when the second component is released from the stops to assure uniform pressure across the wafer during polishing.

The third component includes a contact element by which an electrical contact with the wafer is provided to permit wafer plating. The contact element may be formed by a contact ring, or may be formed by several conductive pieces which form a contact ring. The contact element is sandwiched between sections of the third component, and includes a seal mounted between the contact element and one of these sections. The seal isolates the electrical contact from electrolyte during the plating operation.

The second component includes holes extending through a face thereof by which the wafer can be pulled under vacuum towards and blown under pressure away from the face. A soft backing pad is mounted on the face of the second component and has a rough or textured surface facing the wafer during the plating and polishing operations.

Other objects, advantages and novel features of the present invention will become apparent from the following detailed description of the invention when considered in conjunction with the accompanying drawings.

DESCRIPTION OF THE PREFERRED EMBODIMENTS

A detailed explanation of the invention will now be presented with reference to the figures mentioned.

Figure 2:
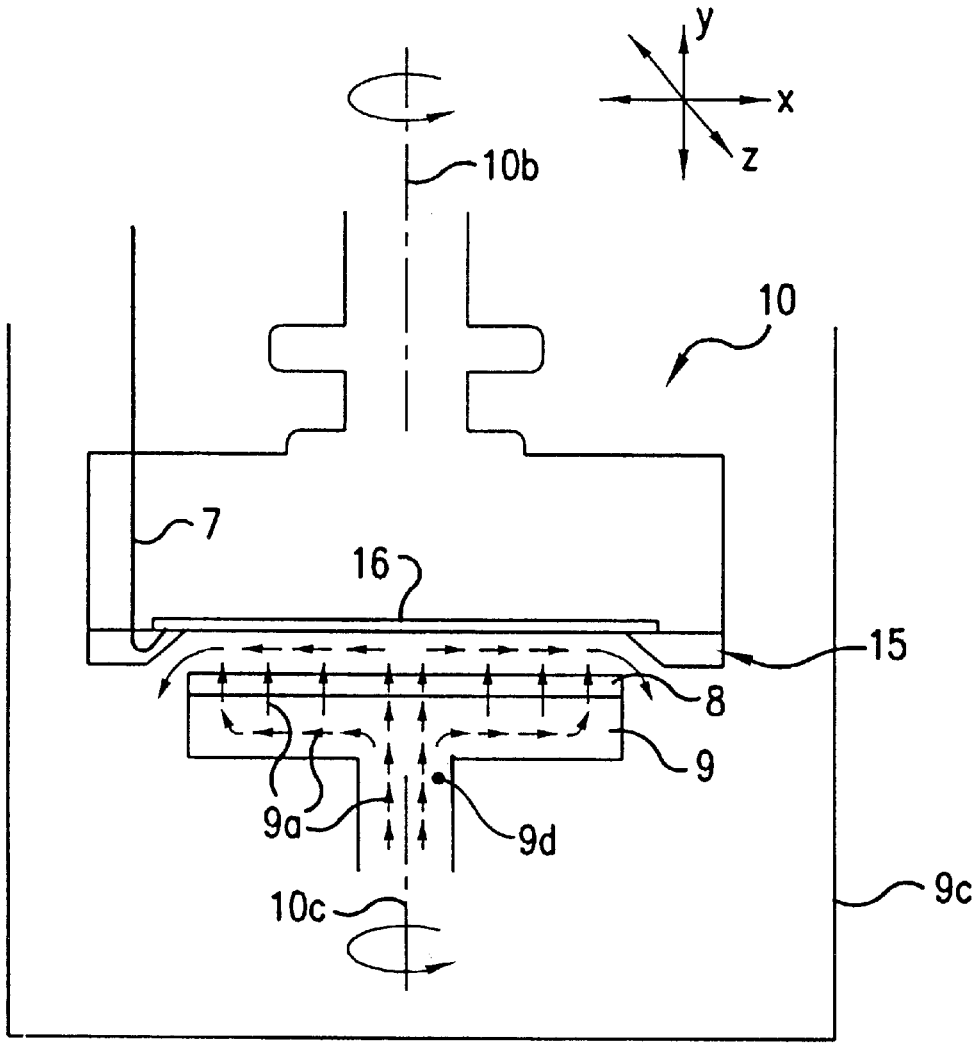
FIG. 2 is a schematic illustration of an overall apparatus design in which a work piece carrier head according to the present invention can be used.

A highly shematic, very general depiction of one version of a plating/polishing apparatus in which the carrier head of this invention can be used is shown in FIG. 2. The carrier head 10 holds a semiconductor wafer 16 using a clamp ring 15 and, at the same time, provides an electrical lead 7 connected to a seed layer on the lower wafer surface. The head can be rotated about a first axis 10*b*. The head can also be moved in x, y, and z directions. A polishing pad 8 is placed on an anode plate 9 across from the wafer surface. The polishing pad surface may itself be abrasive or may contain an abrasive material. Electrolyte 9*a* is supplied to the wafer surface through openings in the anode plate and the pad as shown by the arrows in FIG. 2. The electrolyte then flows over the edges of the pad 8 and into the chamber 9*c* to be recirculated after cleaning/filtering/refurbishing. An electrical contact 9*d* is provided to the anode plate, and the anode plate turns around a second axis 10*c*. In some applications, the anode plate may also be translated in the x, y, and z directions. Axes 10*b* and 10*c* are substantially parallel to each other. The diameter of the pad 8 is smaller than the diameter of the wafer surface exposed to the pad surface. The gap between the wafer surface and the pad is adjustable by moving the carrier head and/or the anode plate in the y direction. When the wafer surface and the pad 8 touch, the pressure exerted on the two surfaces can also be adjusted.

Figure 1A:
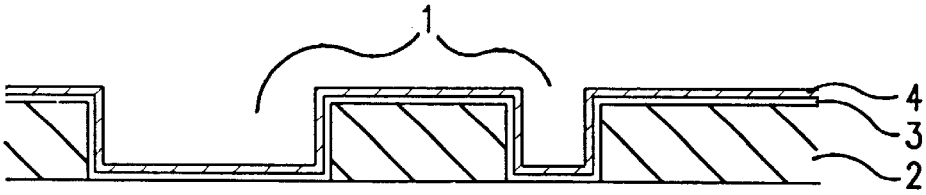
FIG. 1a PRIOR ART
FIG. 1*a* is a partial cross-sectional view of a patterned insulator layer, located on a semiconductor wafer surface and overlying barrier and seed layers, prior to electrodeposition of Cu.
Figure 1B:
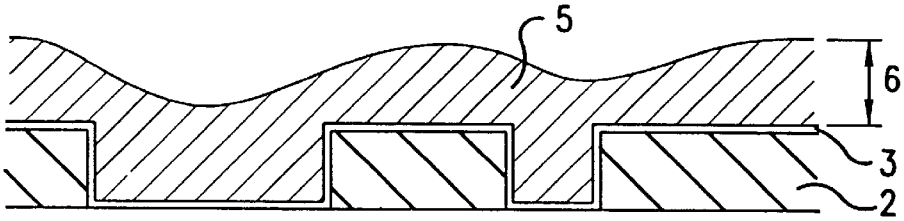
FIG. 1b PRIOR ART
FIG. 1*b* is a view similar to FIG. 1*a* but showing the layer structure and variation of overburden across the substrate after electrodeposition of Cu.
Figure 1C:
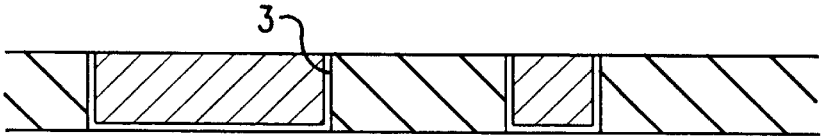
FIG. 1c PRIOR ART
FIG. 1*c* is a view similar to FIG. 1*b* but showing the layer structure after metal planarization to electrically isolate metal-filled features of interest in the patterned insulator layer.
Figure 1D:
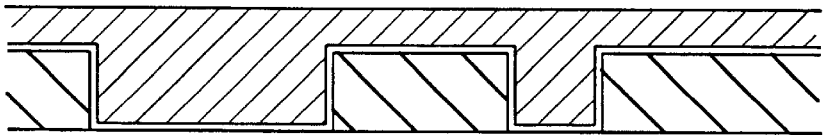
FIG. 1*d* is a view similar to FIG. 1*b* but showing a conductive layer, after deposition in a plating and polishing apparatus, which has a uniform overburden across the substrate surface.
Figure 1E:
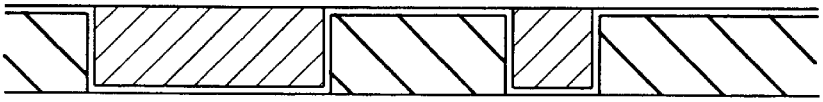
FIG. 1*e* is a view similar to FIG. 1*d* but showing the layer structure resulting when the pressure with which the substrate and the pad surfaces touch each other is increased.

For plating, a potential is applied between the electrical lead 7 to the wafer 16 and the electrical contact 9*d* to the anode plate 9, making the wafer surface more negative than the anode. Under applied potential, copper plates out of the electrolyte onto the wafer surface. By adjusting the gap between the pad and the wafer surface and/or by adjusting the pressure with which the pad and the wafer surface touch each other, one can achieve just plating, or plating and polishing. For example, if there is a gap between the wafer surface and the pad, then plating is expected to take place over the whole wafer surface as illustrated in FIG. 1*b*. If the pad and the wafer surface are touching at low pressures, then plating can freely take place in the holes in the substrate where there is no physical contact between the wafer surface and the pad, but the plating rate will be reduced on the top surfaces where there is physical contact between the pad and the surface. The result is a metal deposit with uniform metal overburden across the surface of the substrate as shown in FIG. 1*d*. This is in contrast to the result produced by the conventional deposition method which is shown in FIG. 1*b*, where there is a significant variation in metal overburden across the substrate. If the pressure with which the substrate and the pad surfaces touch each other is further increased, then it is possible to obtain plating just in the holes as shown in FIG. 1*e*. In this case, the increased polishing action on the high points of the substrate surface does not allow accumulation of a metal layer on these regions. Reversing the applied voltage polarity in the set-up of FIG. 2 can provide electro-etching or electro-polishing of the wafer surface, if desired.

Figure 3A:
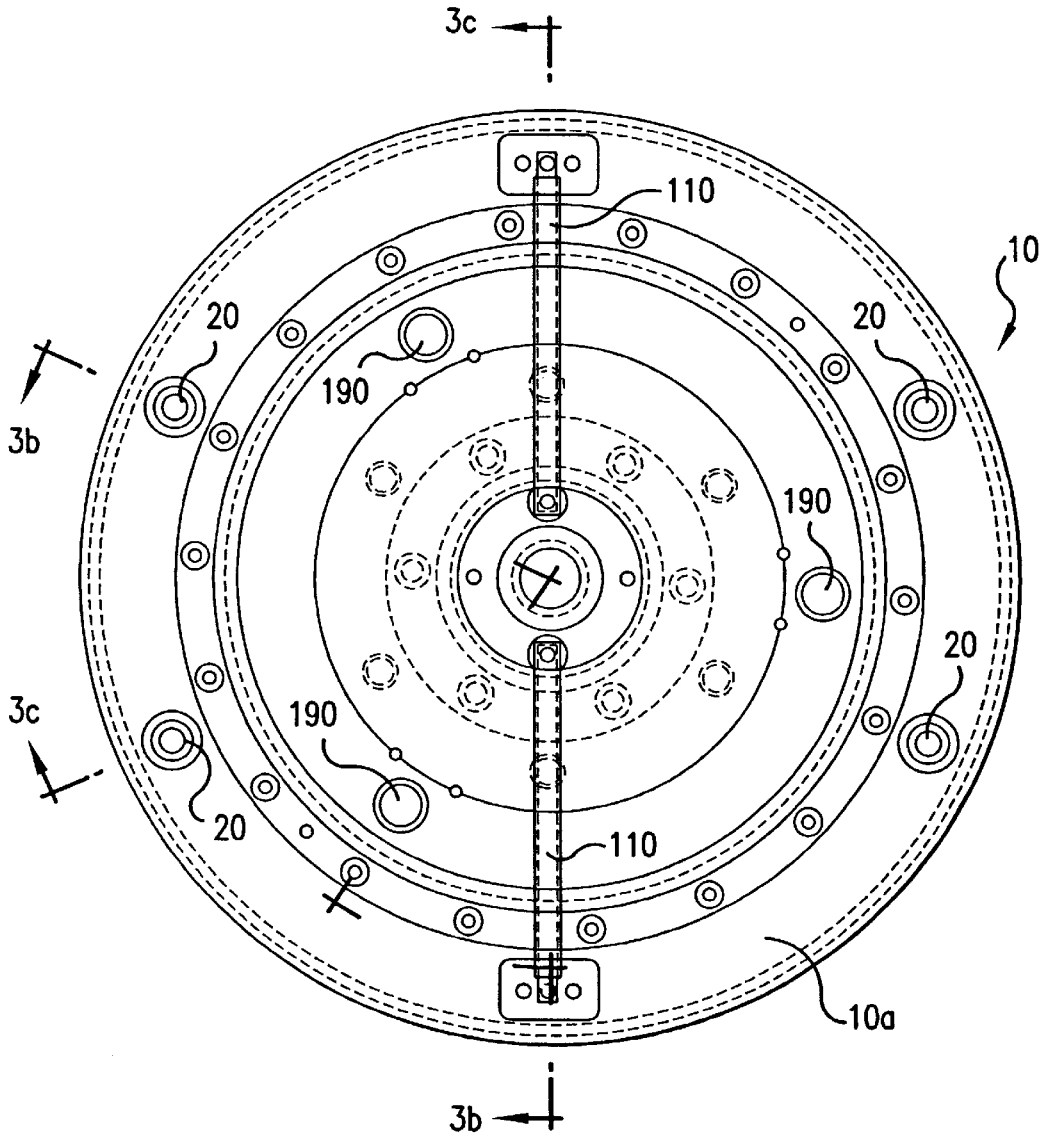
FIG. 3*a* is a top view of a head block of a carrier head according to the present invention.
Figures 3B, 3E:
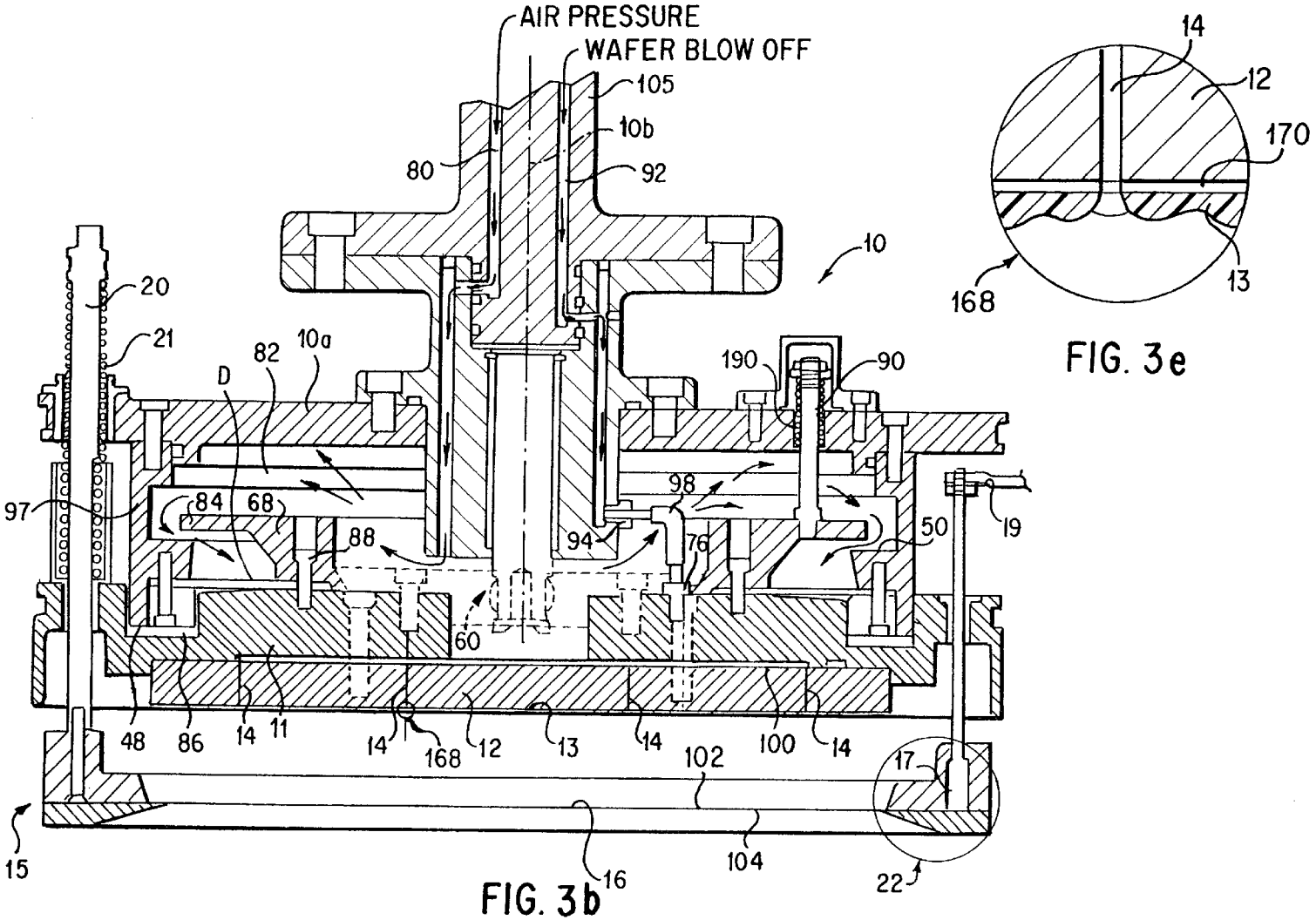
FIG. 3*b* is a sectional view of the carrier head shown in FIG. 3*a* along line 3*b*—3*b*.
FIG. 3*e* is an enlarged sectional view of a backing pad as it appears when mounted on a chuck face of the carrier head.
Figure 3C:
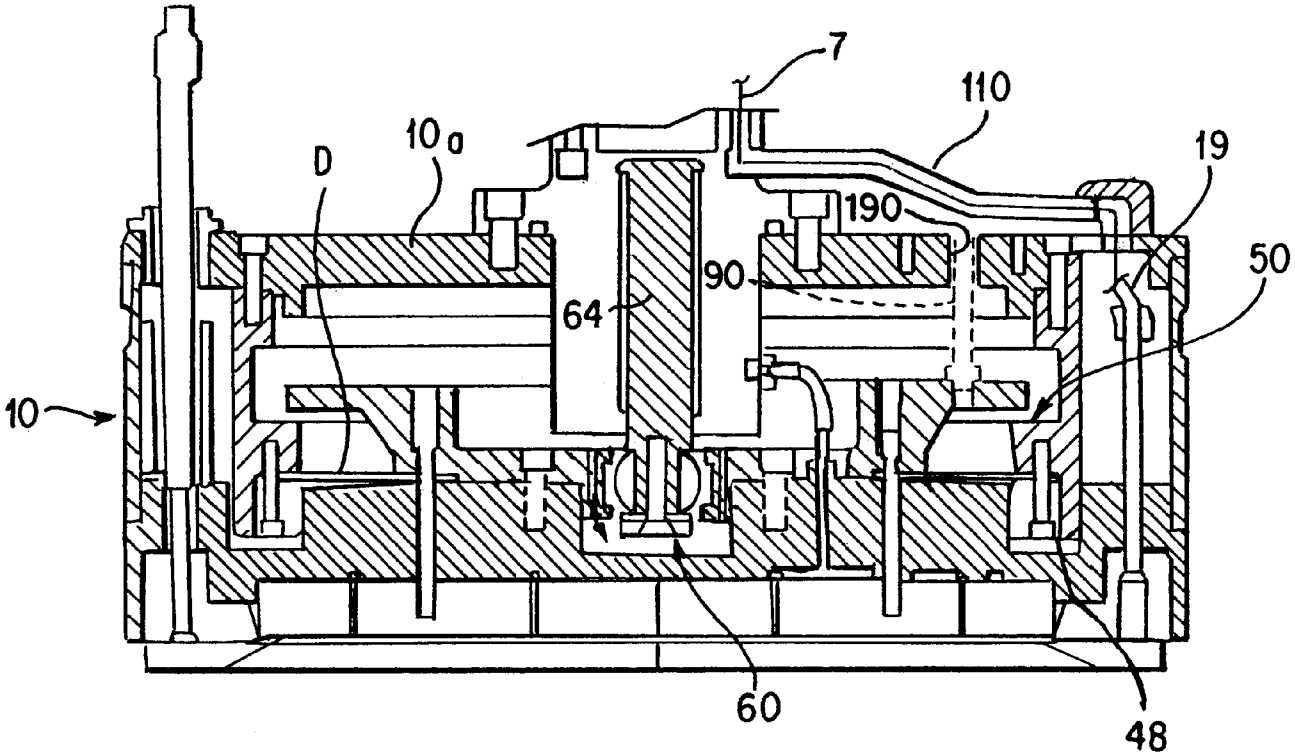
FIG. 3*c* is a sectional view of the carrier head shown in FIG. 3*a* along line 3*c*—3*c* which shows, among other elements, a gimbal mechanism which facilitates uniform pressure distribution across a wafer surface.

A head block 10*a* of the carrier head 10 is more particularly illustrated in FIGS. 3*a*, 3*b*, and 3*c*. FIG. 3*b* is an illustration of the carrier head 10 in its "loading or unloading" position. In the position illustrated in FIG. 3*b*, the wafer 16 can be loaded to the head or unloaded from the head. FIG. 3*c*, by contrast, shows the carrier head in its "plating or polishing" position.

The carrier head 10 contains three main components or sections. The first of these components or sections includes the head block 10*a* coupled to a shaft 10*s* which is capable of rotating the whole carrier head at speeds ranging from 0 to anywhere in the range of 5–4000 rpm around the first axis 10*b*. Both the shaft 10*s* and the shaft of the anode plate 9 (see FIG. 2) are coupled to electric motors which are controlled by a programmable unit such as a computer. The second component or section of the carrier head is located right below the head block 10*a* and includes a chuck 11 and a chuck face 12, which is fastened to the chuck 11. A diaphragm D is clamped to both the chuck 11 and the head block 10*a* and extends between the chuck and the head block, facilitating the application of controlled amounts of fluid (gas) to apply pressure on the chuck 11. The gas supplied may be nitrogen, clean dry air (CDA), or any other suitable gas. Under pressure supplied by way of a first channel 80 in the shaft 10*s* to an expandable volume 82 defined within the head block 10*a*, the chuck 11 can be moved down against a bias provided by balance pin and spring arrangements 90, which are received within bores 190 defined in the head block. The chuck is movable in this fashion away from an upward movement stop 48 defined on a generally cylindrical side wall 97 of the head block 10*a* by approximately 1–9 mm. The expandable volume 82 is formed by a space bounded by the head block 10*a* and the diaphragm D. When fully extended down from the head block 10*a*, the flange 84 of a stop element 68 forming part of the chuck 11 rests on a downward movement stop 50 defined on the side wall 97 of the head block 10*a*. Engagement between the flange 84 and the downward stop 50 keeps the wafer surface substantially perpendicular to the axis 10*b*. There is also a gimbal mechanism 60 provided for the chuck 11. The gimbal mechanism is most clearly shown in FIGS. 3*c* and 3*d*.

The gimbal mechanism becomes effective during plating/polishing when the lower wafer surface is pushed against the pad 8 (see FIG. 2), the stop 48 does not engage the bottom of the recess 86 in the chuck 11 (i.e., the chuck 11 is not fully retracted), and the stop 50 does not engage the flange 84 of the stop element (i.e., the chuck 11 is not fully extended). In this situation, the gimbal mechanism assures uniform pressure distribution across the wafer surface.

Figure 3D:
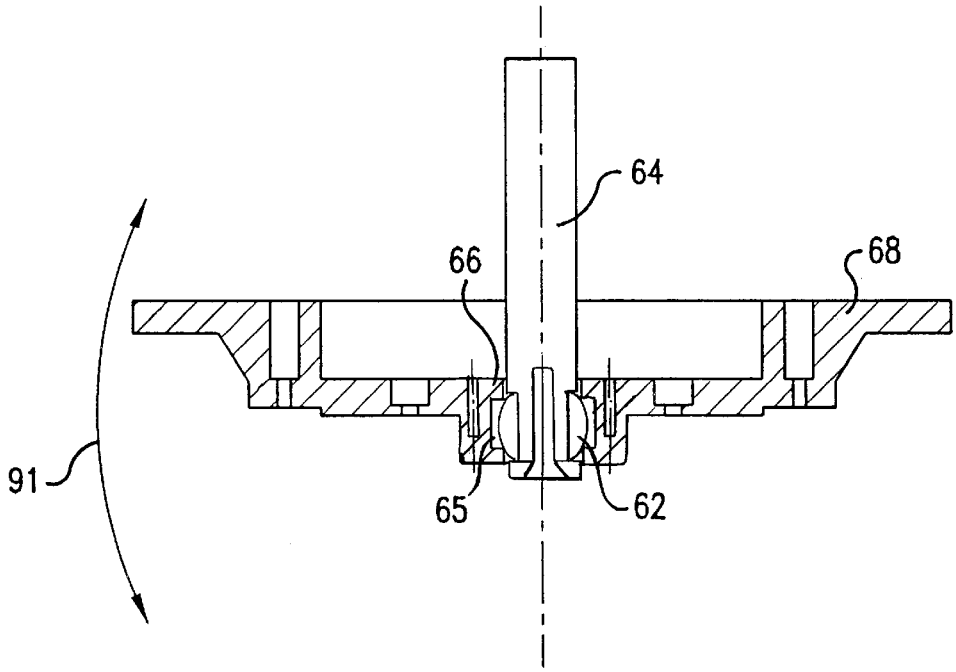
FIG. 3*d* is an isolated view of those elements in FIG. 3*c* which form the gimbal mechanism.

The gimbal mechanism 60 is of a type commonly used in polishing heads, and includes a spherical bearing 62 mounted on a stabilizing shaft 64 as shown in FIG. 3*d*. The outer surface of the spherical bearing is received within a corresponding concavity 65 defined in a bearing receptacle 66, which is mounted at the center of the stop element 68. Bolts 88 are used to clamp the inner circumferential portion of the diaphragm D, the stop element 68, and the rest of the chuck 11 together. The stop element 68, the rest of the chuck 11 and, as a result, the chuck face 12, are thus provided with play in the direction indicated by an arrow 91 in FIG. 3*d* when the chuck 11 is partially but not fully extended away from the stop 48 on the head block 10*a*.

The chuck face 12 is bolted or otherwise secured to the chuck 11 and contains, on one of its surfaces, the backing pad 13 on which the back side of the wafer 16 rests during processing. The backing pad 13 is preferably made of a chemical resistant, hydrophobic polymeric soft material which can act as a cushion between the wafer 16 and the hard surface of the chuck face 12 when the wafer is pushed toward the chuck face by the clamp ring 15. Vacuum/pressure holes 14 come through the chuck face 12 and go through the backing pad 13. A second channel 92 in the shaft 10*s* forms a dual purpose vacuum production and gas pressure supply line. By way of this second channel 92, as well as by way of fittings 94 and 96, a hose 98 connecting the fittings, and a vacuum pressure distribution volume 100, a vacuum can be pulled and gas pressure can be exerted through the holes 14 when the wafer back surface 102 rests against the backing pad 13.

The third component or section of the carrier head 10 is formed by the clamp ring 15, which is shown in FIG. 3*b* in its extended "loading or unloading" position, with the perimeter of the wafer 16 supported by the clamp ring 15. The channels 80 and 92 lead to a conventional rotary union (not shown) for pressure supply, pressure relief, and vacuum production as needed.

Figure 4:
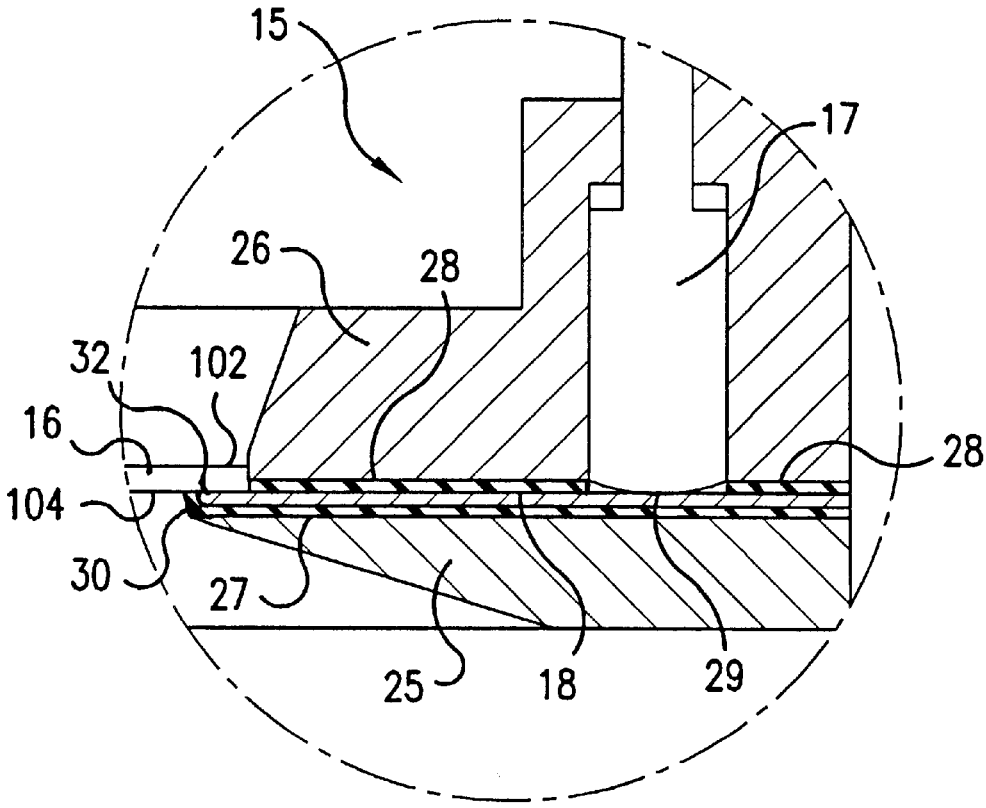
FIG. 4 is an enlarged view of the circled area of FIG. 3*b*.

FIG. 4 is a more detailed illustration of the clamp ring 15 and shows an enlarged representation of the circled area 22 of FIG. 3*b*. A contact pin 17 makes electrical contact with a contact ring 18 and carries power to the contact ring 18, and thus to the wafer front surface 104, from the power lead 7 and connection 19. There can be two or more contact pins. In the carrier head configuration represented in FIG. 3*a*, the contact pins (not shown in FIG. 3*a*) are in positions directly opposite to each other. Each electrical conductor or lead 7 passes through a conduit 110 and upward through a third channel in the shaft 10*s* to a conventional rotary contact for electrical supply. A mercury contact is preferred because of the low electrical noise produced. This rotary contact is located at the end of the shaft 10*s* and is not illustrated.

Pushrods 20 can move the clamp ring 15 up or down. The down motion of each of the pushrods is controlled by a pressure cylinder (not shown). When gas pressure is cut off, compression springs 21 push the clamp ring up, pressing the wafer back surface 102 against the backing pad 13. FIG. 3*a* shows four 20 pushrods 20, although more may be employed. In the carrier head of FIGS. 3*b* and 3*c*, the chuck 11 can move down away from the head block 10*a* by about 1–9 mm under applied gas pressure, forcibly pressing the wafer surface 104 against the polishing pad 8 during polishing.

The clamp ring 15 has a first section, including a seal clamp ring 25, and a second section, having a clamp ring block 26. Sandwiched between these two sections are a wafer seal 27, the contact ring 18, and a polymeric seal 28. The contact pin 17 makes electrical contact with the contact ring 18 at a point 29. Tips 32 of the contact fingers extending from the contact ring 18 are shaped in a way that assures good electrical contact between the tips 32 and the front surface 104 of the wafer. The specially shaped lip 30 at the inner perimeter of the wafer seal 27 rests against the front surface of the wafer 16 and provides a liquid tight seal when the clamp ring 15 moves up, pushing the back surface of the wafer 16 against the backing pad 13 while pushing the lip 30 of the wafer seal 27 and the contact finger tips 32 against the front surface 104 of the wafer 16. This tight seal prevents electrolyte from reaching the electrical contact region during the plating/polishing process. The wafer seal 27 also enhances the fatigue life of the contact ring 18 and the fingers extending from it.

Figure 5A:
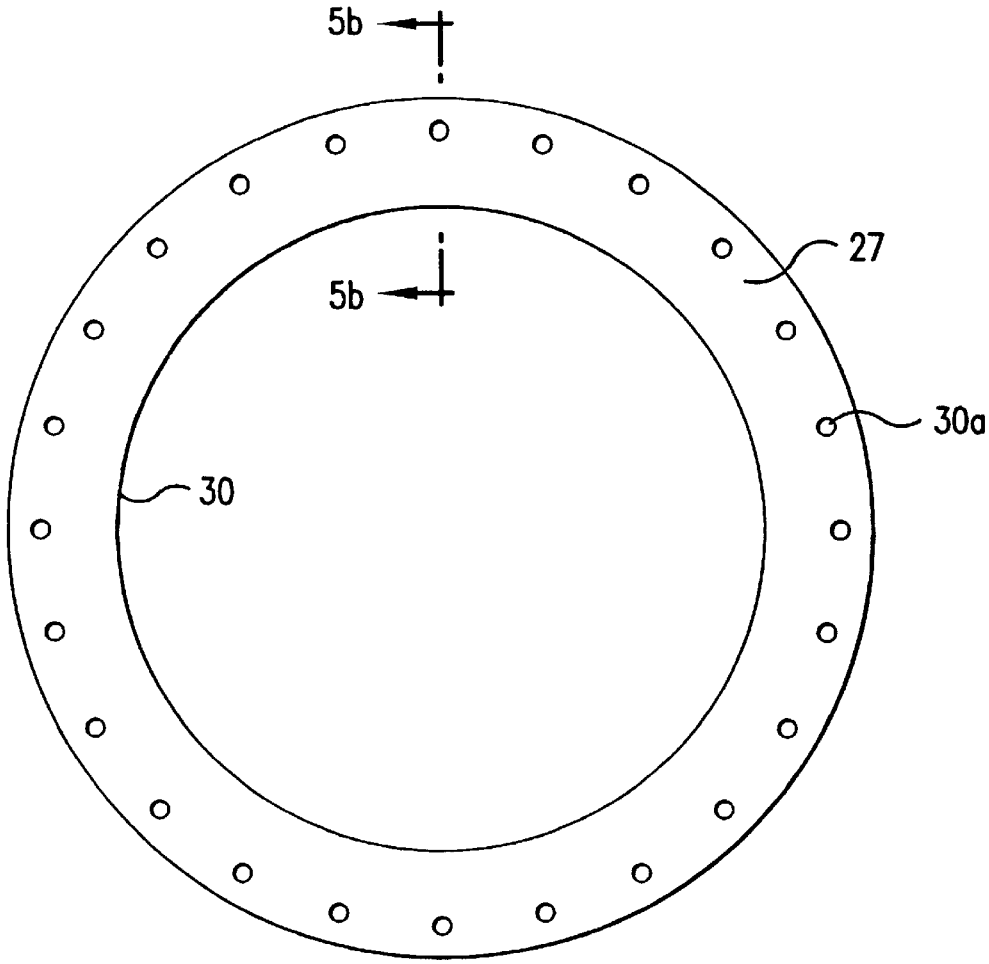
FIG. 5*a* is a top view of the wafer seal shown in FIG. 4.
Figure 5B:
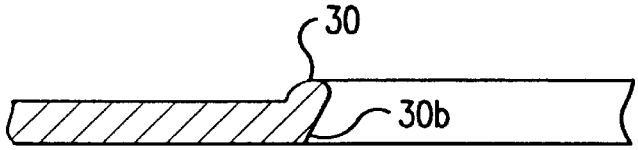
FIG. 5*b* is a part-sectional view of the wafer seal shown in FIG. 5*a* along line 5*b*—5*b*.

FIGS. 5*a* and 5*b* show top and cross-sectional views, respectively, of the wafer seal 27. Holes 30*a* are used for receiving bolts (not shown) attaching the seal clamp ring 25 to the clamp ring block 26. The wafer seal 27 and the lip 30 are an integral unit manufactured of a polymeric substance that is resistant to chemicals and does not shed particulates when wet or dry. The angle 30*b* at the inner edge of the lip 30 can be 305 90 degrees; this angle is preferably less than 90 degrees so that the seal does not trap any liquid between the wafer surface and the lip.

Returning to FIGS. 3*b* and 4, the contact pin 17 can move up and down together with the clamp ring 15. The electrical contact between the contact pin and the contact ring needs to be stable and to have low resistance so that an excessive voltage drop in this region during electroplating is avoided. Therefore, the surfaces of the contact pin and the contact ring have to be coated with materials that are of low resistivity and that have superior corrosion resistance. Examples of such materials are platinum, palladium, and gold. The physical area of electrical contact at point 29 between the contact pin 17 and the contact ring 18 can be increased to reduce contact resistance in this region by employing a highly conductive soft material or a liquid conductor around the point of electrical contact 29. Examples of appropriate liquid conductors are gallium and gallium-indium alloys.

Figure 6A:
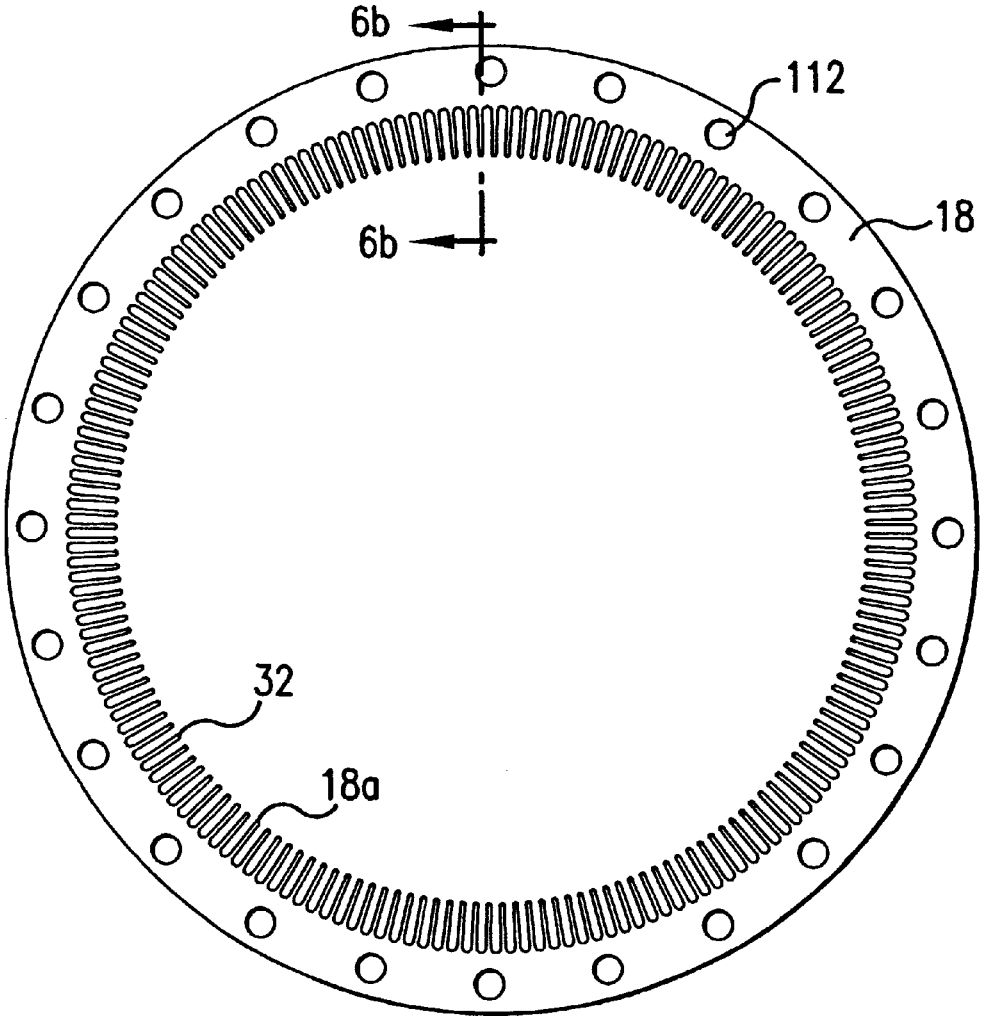
FIG. 6*a* is a top view of the contact ring shown in FIG. 4.
Figure 6B:
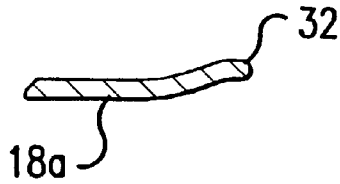
FIG. 6*b* is a part sectional view of a finger of the contact ring of FIG. 6*a* as seen along line 6*b*—6*b*.

FIGS. 6*a* and 6*b* show the structure of the contact ring 18. The contact ring includes holes 112, in locations corresponding to those of the holes 30*a*. Fingers 18a extend radially inward from the solid body portion of the contact ring 18 towards the center of the ring. The tips 32 of the fingers are shaped in a way which assures good physical and electrical contact with the wafer surface when the fingers 18a are pushed against the wafer.

The contact ring 18 shown in FIGS. 6*a* and 6*b* is a continuous ring. However, the contact ring may consist of two or more pieces (segments) that, when put together, form a ring. The segments do not physically touch each other. In other words, two pieces that are semicircular in shape and have small gaps between them can be used instead of one continuous circular ring. Three or more pieces can also be used. If more than one piece is used to form the contact ring, then each piece should be individually contacted with a contact pin 17 of its own. This assures good electrical connection to each segment of the contact ring. Using such a segmented contact ring design is preferable because such contacts can be used to sense if the substrate is placed properly onto the clamp during the loading step.

The backing pad 13 is made of a soft polymeric material and is mounted on the chuck face 12 using standard methods such as with double-sided adhesive sheets 170. FIG. 3*e* is an enlarged view of area 168 of FIG. 3*b* and schematically illustrates the configuration of the backing pad when mounted on the chuck face. It is preferred to have the backing pad material resistant to chemicals and of a type which does not shed particulates when wet or dry. Most preferably, the backing pad 13 has hydrophobic surface. The surface of the backing pad facing the back side 102 of the wafer 16 is rough, with feature sizes of 1–20 mils. This rough surface has certain advantages.

When the wafer is pushed against the backing pad by the clamp ring and a vacuum is pulled though the vacuum/pressure holes 14, micro channels defined on the backing pad surface by the features allow uniform distribution of vacuum, which efficiently pulls the wafer onto the backing pad, securing it in place. Once the wafer is pulled, by vacuum produced by way of the dual purpose line 92, onto the backing pad surface, the rough but soft backing pad surface is flattened, increasing the contact area between the pad and the wafer, thus increasing friction. After processing, during wafer unloading, pressured gas is applied through the dual purpose line 92, the fittings 94 and 96, the hose 98, the volume 100, and the vacuum/pressure holes 14 to the back side 102 of the wafer 16. As the wafer 16 is blown off and detaches from the backing pad 13 in this way, the flattened surface features on the pad assume their original shapes, reducing the contact area between the wafer and the pad. Trouble free wafer unloading, without the wafer getting stuck to the backing pad, is therefore allowed.

The operation of the carrier head assembly 10 during loading, plating, polishing, and unloading of a wafer will now be described. Referring to FIGS. 3*b* and 3*c*, the wafer is fed into the carrier head 10 when the clamp ring 15 is down in the "loading or unloading" position as shown in FIG. 3*b*. The wafer 16 is slipped into the center opening of the clamp ring 15 and initially rests (with its front face 104 coated with the Cu seed layer facing down) on the lip 30 of the wafer seal 27 supported by the seal clamp ring 25 (see FIG. 4). Movement of the pushrods 20 is indicated by cutting off gas pressure to the pressure cylinder (not shown) acting on each pushrod 20 so that compression springs 21 become operational. The carrier head assembly 10 then "self-loads" the wafer by moving the clamp ring 15 up towards the chuck 11, pushing the back side 102 of the wafer against the backing pad 13. Vacuum is applied as described above through the dual purpose line 92 and the vacuum/pressure holes 14, and the wafer is secured in place by the action of the vacuum on its back surface 102 as well as by the pressure exerted by the clamp ring 15 all around its perimeter. Proper electrical contact is made with the wafer surface around its circumference by the contact fingers 32 while the lip 30 provides a liquid tight seal.

It is to be noted that the contact fingers are designed such that they are at a plane higher than the lip on the clamp ring.

They are also flexible. Therefore, when the wafer 16 is loaded, the front surface of the wafer first makes contact with the contact fingers. The fingers then move down, under the weight of the wafer, and the wafer surface touches the lip 30. Since the electrical contact to the wafer is already made during this loading step by the contact fingers 18*a*, one is readily able to sense if the wafer is situated flat on the contact ring by sensing the resistance between the various segments of a segmented contact ring.

Although the plating/polishing head described relates to a design with both electrical contact and a liquid tight seal on the front wafer surface 104 near the outer circumference of the wafer, the head can be designed so that the liquid tight seal is on the front wafer surface but with the electrical contact right at the edge of the wafer or on the back inner wafer surface 102. In this way, the unused contacting area around the circumference can be minimized by shifting the liquid tight seal closer to the edge. To be able to make electrical contact at the edge of the wafer or on the back wafer surface, the conductive barrier layer and the seed layer should be extended to the edge of the wafer or wrapped around to the back of the wafer.

With the wafer securely placed on the chuck face and with the edge of the wafer sealed against liquids, the plating/polishing procedure can be started. Referring to FIGS. 3*b* and 3*c*, a pressure is supplied by way of the first channel to expandable volume 82 closed off by the diaphragm D, causing the chuck 11 to extend down away from the head block 10*a* so that the flange 84 and the stop 50 engage. At this stage, the carrier head assembly 10 in its entirety moves down towards the polishing pad 8 as rotation of the head assembly, the anode plate, or both the head assembly and the anode plate is initiated. The electrolyte flow is also initiated through the anode plate and the pad. Downward movement of the head assembly 10 in its entirety brings the wafer surface 104 to the proximity of the pad surface (typically 0–3 mm) allowing the electrolyte to touch the wafer. Power is applied between the electrical contacts (electrodes) 7 and 9*d* to initiate plating. As described earlier in relation with FIG. 1*a*, 1*b*, 1*d*, and 1*e*, the head assembly 10 is designed to allow close control of the distance between the wafer surface and the pad surface during processing. For plating only, this gap is typically 0.01–2 mm.

For plating and polishing, the wafer surface 104 is first brought into contact with the surface of the pad 8 and then the head assembly is moved down incrementally to cause the chuck 11 be released from the stops 48 and 50, rendering the gimbal mechanism effective. The chuck, at this point, is free to gimbal around the spherical bearing 62. At this stage, the pressure in the expandable volume 82 on the diaphram between the head block 10*a* and the chuck 11 can be adjusted to change the pressure at the wafer/pad interface so that it is between about 0 psi and 5 psi. This pressure is monitored by a pressure transducer (not shown) associated with the supply channel 80 which produces a signal which is translated into psi units. This pressure can be adjusted as well as monitored by a computer in a conventional fashion. Accordingly, the results depicted in FIG. 1*d* or FIG. 1*e* can be obtained.

During the plating/polishing process, the wafer, the polishing pad, or both the wafer and the pad can be rotated. The rotation speeds and directions can be changed at will. Preferably, the polishing pad diameter is smaller than the wafer diameter, and uniform plating/polishing is achieved by moving the polishing pad and the wafer with respect to each other in the x and/or z directions.

At the end of the process, the wafer 16 can be rinsed, spin dried and readied for unloading. During unloading, as pressure is applied to the cylinder acting on each of the pushrods 20 to move the clamp ring 15 down, pressurized gas is sent through the vacuum/pressure holes 14. Through the push of the pressurized gas and the backing pad (as described before), the wafer is released so that it is supported only by the clamp ring 15. The released wafer can then be removed by the operator or a robot. The delivery of the wafer onto the clamp ring and its removal can be done from opposite directions.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A work piece carrier head which can carry a semiconductor wafer while conductive material is deposited on the wafer and while conductive material on the wafer is polished comprising:

a first carrier head component secured to a shaft by which the carrier head can be rotated, translated, and moved up and down;

a second carrier head component connected to said first carrier head component and movable relative to the first carrier head component between a retracted position and an extended position; and a third carrier head component connected to the first and second carrier head components for movement away from said second carrier head component into a wafer loading position, in which the wafer can be loaded onto the third carrier head component, and towards said second carrier head component into a wafer processing position for deposition and polishing of said conductive material, in which the wafer is clamped between the second and third carrier head components, wherein said third carrier head component can support the wafer during said movement and includes a contact element by which power can be carried to the wafer during processing.

2. A work piece carrier head as defined in claim 1, wherein said third carrier head component is biased away from said wafer loading position and towards said wafer processing position.

3. A work piece carrier head as defined in claim 1, wherein said first and second carrier head components define an expandable volume therebetween, and wherein fluid can be supplied to or discharged from the expandable volume to produce relative movement of the first and second carrier head components.

4. A work piece carrier head as defined in claim 3, wherein said relative movement is used to control a distance between a surface of the wafer and a source of plating material during a wafer processing operation.

5. A work piece carrier head as defined in claim 4, wherein the distance is in the range of about 0.01–2.0 mm.

6. A work piece carrier head as defined in claim 1, and further comprising stops defined on the first carrier head component which limit movement of the second carrier head component and define respective fully retracted and fully extended positions of the second carrier head component.

7. A work piece carrier head as defined in claim 6, and further comprising a gimbal mechanism which is rendered .effective when the second carrier head component is released from the stops to assure uniform pressure across the wafer.

8. A work piece carrier head as defined in claim 1, wherein the contact element is formed by a contact ring.

9. A work piece carrier head as defined in claim 1, wherein the contact element is formed by several conductive pieces which form a contact ring.

10. A work piece carrier head as defined in claim 1, wherein the contact element is sandwiched between sections of said third carrier head component, and further comprising a seal mounted between the contact element and one of said sections in order to isolate the contact element from electrolyte.

11. A work piece carrier head as defined in claim 1, wherein the second carrier head component includes holes extending through a face thereof by which the wafer can be pulled under vacuum towards and blown under pressure away from the face.

12. A work piece carrier head as defined in claim 11, and further comprising a soft backing pad mounted on the face of the second carrier head component and having a rough surface facing the wafer during wafer processing.

13. A work piece carrier head as defined in claim 12, wherein said rough surface has feature sizes of 1–20 mils when it is not flattened by the wafer.

14. A work piece carrier head as defined in claim 3, wherein said relative movement is used to control pressure at an interface between a surface of the wafer and a polishing pad surface during a wafer processing operation.

15. A work piece carrier head as defined in claim 14, wherein the pressure is in the range of about 0–5 psi.

16. A work piece carrier head secured to a shaft that can be rotated, translated, and moved up and down, and which can carry a semiconductor workpiece when suction is applied so that deposition of conductive material on the workpiece and polishing of conductive material on the workpiece can occur, comprising:

means for holding the workpiece in a processing position for deposition and polishing of said conductive material, the means for holding including a substantially flat surface with vacuum holes disposed thereon, such that with the workpiece in the processing position and suction applied to the vacuum holes, the workpiece is held to the substantially flat surface;

means for moving the workpiece from a loading position to the processing position, the means for moving attached to the means for holding and including a workpiece carrier portion that supports the workpiece and allows for up and down movement of the workpicce on the workpiece carrier portion between the loading position and the processing position; and a contact pin for establishing a conductive path with the workpiece that is disposed within the workpiece carrier portion.

17. A work piece carrier head according to claim 16 wherein the means for holding further includes a gimbal mechanism.

18. A workpiece carrier head according to claim 16 wherein the workpiece carrier portion is formed by a clamp ring that is moved between the loading position and the processing position using a plurality of pushrods.

19. A work piece carrier head as defined in claim 1, wherein said contact element provides electrical contact with the wafer on a back surface of the wafer.

20. A work piece carrier head as defined in claim 1, wherein said contact element provides electrical contact with the wafer on a back surface of the wafer.

* * * * *